US008231179B2

(12) United States Patent
Willison et al.

(10) Patent No.: US 8,231,179 B2
(45) Date of Patent: Jul. 31, 2012

(54) CUTTER DRUM EXTENSION MECHANISM

(75) Inventors: John E. Willison, Cranberry, PA (US); Joseph P. Gierlach, Franklin, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 445 days.

(21) Appl. No.: 12/433,349

(22) Filed: Apr. 30, 2009

(65) Prior Publication Data

US 2010/0276986 A1 Nov. 4, 2010

(51) Int. Cl.
*E21C 27/24* (2006.01)

(52) U.S. Cl. ..... 299/80.1

(58) Field of Classification Search ..... 299/80.1, 299/64, 55, 56, 58, 73, 34.12, 37.4, 39.4, 299/39.1, 39.5, 39.6, 39.9, 43, 44; 92/24, 92/27, 33, 52, 93, 107, 108, 117 R
See application file for complete search history.

(56) References Cited

U.S. PATENT DOCUMENTS

| | | | | |
|---|---|---|---|---|
| 3,516,712 | A | 6/1970 | Bennett et al. | |
| 3,617,093 | A | 11/1971 | Daily | |
| 3,695,725 | A | 10/1972 | Pendolino | |
| 4,003,297 | A | 1/1977 | Mott | |
| 4,489,985 | A | 12/1984 | Kendrick | |
| 7,174,828 | B2 * | 2/2007 | Davies et al. | 92/115 |
| 7,475,947 | B2 | 1/2009 | LeBegue | |

FOREIGN PATENT DOCUMENTS

JP 2000-97206 4/2000

OTHER PUBLICATIONS

Search Report UK Patent Application No. GB1007923.4, dated Aug. 12, 2010.

* cited by examiner

*Primary Examiner* — Sunil Singh
(74) *Attorney, Agent, or Firm* — Michael Best & Friedrich LLP

(57) ABSTRACT

A continuous mining machine cutting head structure is set forth. The head member is of the type having axially extensible and retractable end portions. Included within the head member is a toroidal hydraulic cylinder for selectively extending and retracting these end portions.

3 Claims, 6 Drawing Sheets

CUTTER DRUM EXTENSION MECHANISM

BACKGROUND

This disclosure relates to a continuous mining machine, and more particularly, to a continuous mining machine having a cutter drum member with extendable end portions. The present disclosure is directed to a means for extending, retracting and locking the cutter drum extensions in their extended position.

In a continuous-mining apparatus of the type employed in this invention, a cutting head mechanism is used to dislodge material from a mine vein and is operable to provide a mine passageway or room into which the apparatus advances and mining progresses. The cutting head mechanism is pivotably mounted on a mobile base to swing in a vertical plane between the mine roof and floor and includes a rotary drum cutting head assembly arranged on a horizontal transverse axis and having teeth or bits which tear away and dislodge the mineral. The apparatus also includes a conventional loading head for gathering the loose mineral on the mine floor and moving it rearwardly and inwardly towards the forward receiving portions of the conveying means of the apparatus. The rotary drum cutting assembly has end portions thereof which can be selectively extended or retracted, to respectively, dislodge mineral from the ribs and corners of the mine passageway and reduce the effective length of the cutting head assembly to provide clearance at the sides of the assembly.

As shown in FIG. 1, a continuous mining machine generally designated as 10, may assume various forms but, for illustrative purposes, herein comprises a crawler base 14 carrying a frame 16 on which a forwardly extending mining boom or support member 18 is pivotally mounted at the forward end of the frame 16 to swing up and down between a mine roof and a mine floor. An elongated mining head member 24 (also called a cutter head) extends transversely to the support member 18 and is rotatably secured thereto at the forward end thereof. The mining head member 24 is mounted for powered rotation about a longitudinal axis X-X of the head member. Pivotally mounted at the forward end of the frame 16 and extending forwardly there from beneath the support member 18 is a conventional loading head 26 having oscillatory gathering arms 28 for engaging mine mineral and moving such mineral rearwardly and inwardly towards well known conveying means 30 of the mining machine 10. Conventional hydraulic jacks (not shown) serve to swing the support member 18 in a vertical plane about the pivot axis thereof and to tilt the loading head 26 about the horizontal axis.

The elongated mining head member 24 is driven from a pair of motors 34. As shown motors 34 are in spaced axial alignment and extend generally parallel to the head member 24. A support member 18 at opposite side portions thereof suitably carries motors 34.

The drive from motors 34 rotatably drives a cutting head assembly head shaft 36. Head shaft 36 extends parallel to the longitudinal axis of the head member 24 and is captively and rotatably supported by tubular gear casing extensions 38 that also extend parallel to the longitudinal axis of the head member. The gear drive system for the mining head member may be that shown in either U.S. Pat. No. 3,617,093 or U.S. Pat. No. 3,695,725, or of other conventional construction.

As hereinafter described, head shaft 36 rotatably drives: an endless circulating belt type continuous hinge cutter chain 48, hollow cylindrical rotary drum cutting heads 50 and hollow cylindrical rotary drum cutting head extension portions 52 which include cylindrical portion 66 which are partially slideably, received within the ends of respective cutting heads 50. The portions 52 are selectively hydraulically extendable and retractable there from. An operator can selectively extend or retract the extension portions via a hydraulic control system.

Examples of conventional mining machine drum cutter extension means are shown in U.S. Pat. No. 4,489,985, and U.S. Pat. No. 3,516,712.

In U.S. Pat. No. 4,489,985, as can be seen in prior art FIGS. 2 and 3, the head shaft 36 drives the outer peripheral member 60 of the cutting head 24 via drive ring 72 which engage a plurality of circumferentially spaced keys 74. The outer peripheral member 60 is supported on casing extension 38 by bearing 76 and other internal bearings (not shown).

The hollow cylindrical rotary drum extendable end portions 52 have an inner diameter thereof larger than the outer diameter of cutting head 60 and are rotatably driven by the cutting head 60. As shown in FIGS. 2 and 3, a plurality of circumferentially spaced keys 82 has the inner ends thereof fixedly secured to the outer peripheral portion of the cutter head 60. Consequently, the head 60 drives the end portions 52 by means of keys 82 drivingly engaging respective ones of a plurality of cooperating key ways in the end portions 52. The keys 82 and the key ways 84 are circumferentially spaced about the inner periphery of the end portions 52. The above described key and key way driving arrangement additionally allows for the reciprocal axial movement of cutting head end portions 52 with respect to cutting heads 60 by the axially sliding relationship which exists between keys and key ways 82 and 84, respectively.

A hydraulic cylinder 90, in conjunction with its piston rod 92, accomplishes the extension of the end portions 52. The rod 92 is fixedly connected to plate 94 that is slidably mounted within the inner diameter of cylinder 66 of end portion 52. An annular drive ring 96 is fixedly attached to the inner diameter of cylinder 66 for movement therewith. Drive ring 96 has a plurality of holes 99 within its outer annular surface to accommodate a plurality of bolts 98 which have one end threadably engaged with the piston 94 for movement therewith and the other end fixedly attached by threads to latch release member 100. The holes 99 located on drive ring 96 have a diameter slightly larger than the diameter of bolt 98 to permit the bolts 98 to slide there through. Consequently the piston 94 and the latch release member 100 move as a unit in the direction of longitudinal axis X-X.

As can be best seen in FIG. 2, at least one latch member 102 is pivotally mounted on a mounting ring 104 that is fixedly attached to head shaft 36 for rotation therewith.

U.S. Pat. No. 3,516,712 discloses a mining machine with an extendable head having a spring return mechanism. The means for extending the extensible head is a hydraulic cylinder. More particularly, as shown in FIG. 4, there is a shaft 87 extending axially through the mining head 13. The end mining head section 70 has its telescoping cylinder part 71 slidably mounted on the shaft 87 with a key 88 in a keyway 89. A slide collar 90 is secured to the outer end of the shaft 87, and a mating inner cylinder 91 is slidably engaged with the slide collar 90 in sealed engagement. A bore 92 extends through the shaft 87 to the inner cylinder 91. Hydraulic fluid is delivered through the bore 92 into the inner cylinder 91 to move the telescoping cylinder part 71 and the end mining head section 70 outwardly relatively to the shaft 87.

A coil spring 93 is disposed between the outer mining head section 65 and the telescoping cylinder part 71. A ring 94 is secured to the outer mining head section 65 abutting one end of spring 93, and a ring 95 is secured to the inner end of the telescoping cylinder part 71 abutting the other end of spring 93. In the extended position of the end mining head section 70, as seen in FIG. 5, the spring 93 is compressed between the rings 94, 95, and the end mining head section 70 is held in its extended position by hydraulic fluid trapped within the inner cylinder 91. The end mining head section 70 is retracted by release of the hydraulic fluid from the inner cylinder 91, and the force of the spring 93 between rings 94, 95 withdraws the telescoping cylinder part along the shaft 87 and within the outer mining head section 65.

SUMMARY

It is an object of this disclosure to provide a better drum extension portion than that provided in the above cutting heads. In conventional cutting heads, the forces acting to extend and lock the drum extension portions is sometimes inadequate, resulting in machine operators sometimes welding the drum extension portions in their extended position. It is an object of this disclosure to provide a drum extension portion with more extension force and locking force than in conventional cutting heads. More particularly, the disclosed drum extension force has extension and locking forces more than four times stronger than in conventional cutting heads.

In this disclosure, there is provided an improved continuous mining machine of the type that includes an elongated body portion mounted on devices for propelling the body portion. A support member is pivotally secured to the body portion and extends forward there from. An elongated mining head member is mounted on the forward end of the support member for powered rotation about a longitudinal axis of the head member. The head member has axially extensible and retractable drum extension portions.

The drum extension portion includes an inner end structure attached to the main cutting head portion, and an outer cylinder attached to the inner end structure. The drum extension portion also includes an inner cylinder attached to the inner end structure and having an outer surface, and the inner cylinder is coaxial with and received within but spaced apart from the outer cylinder. The drum extension portion also includes an extendable cylinder having an inner annular enlarged end, with a portion of the extendable cylinder being received between the inner cylinder and the outer cylinder. A first space is defined between the inner end structure and the enlarged end of the extendable cylinder. The drum extension portion also includes an end cap having a flange that receives coaxially within it the outer end of the inner cylinder, and the extendable cylinder enlarged end is received between the end cap flange and the outer cylinder. A second space is defined between the inner cylinder and the extendable cylinder and between the extendable cylinder enlarged end and the end cap flange, so that when fluid enters the first space and leaves the second space, the extendable cylinder moves to the extended position, and so that when hydraulic fluid enters the second space and leaves the first space, the extendable cylinder moves to the retracted position.

DESCRIPTION OF THE PREFERRED EMBODIMENT

Figure 1:
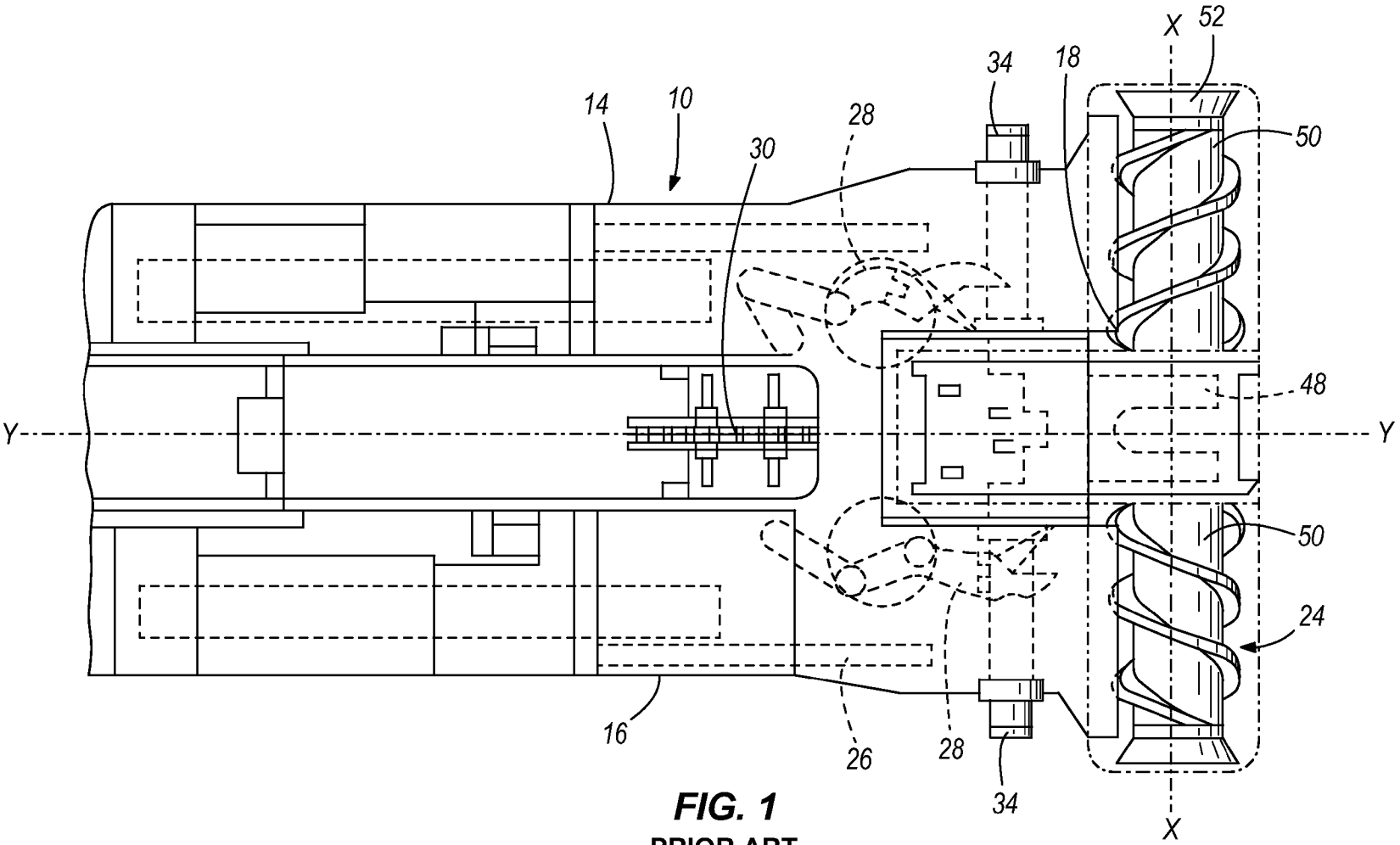
FIG. 1 PRIOR ART
FIG. 1 is a partial plan view of a mining machine.
Figure 2:
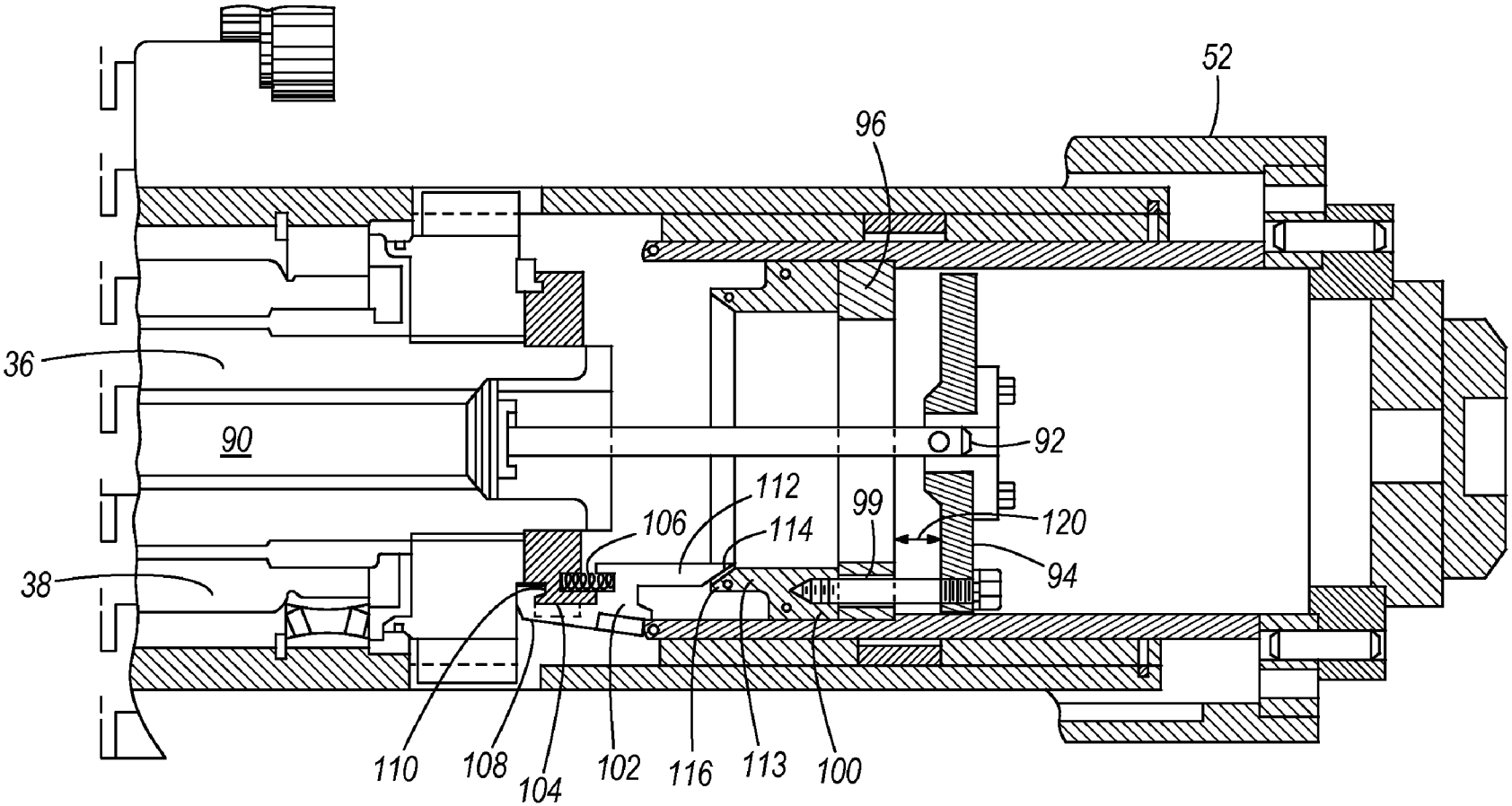
FIG. 2 PRIOR ART
FIG. 2 is an enlarged view showing a prior main gear casing in a portion of a cutter head assembly, with a latch mechanism in its locked position.
Figure 5:
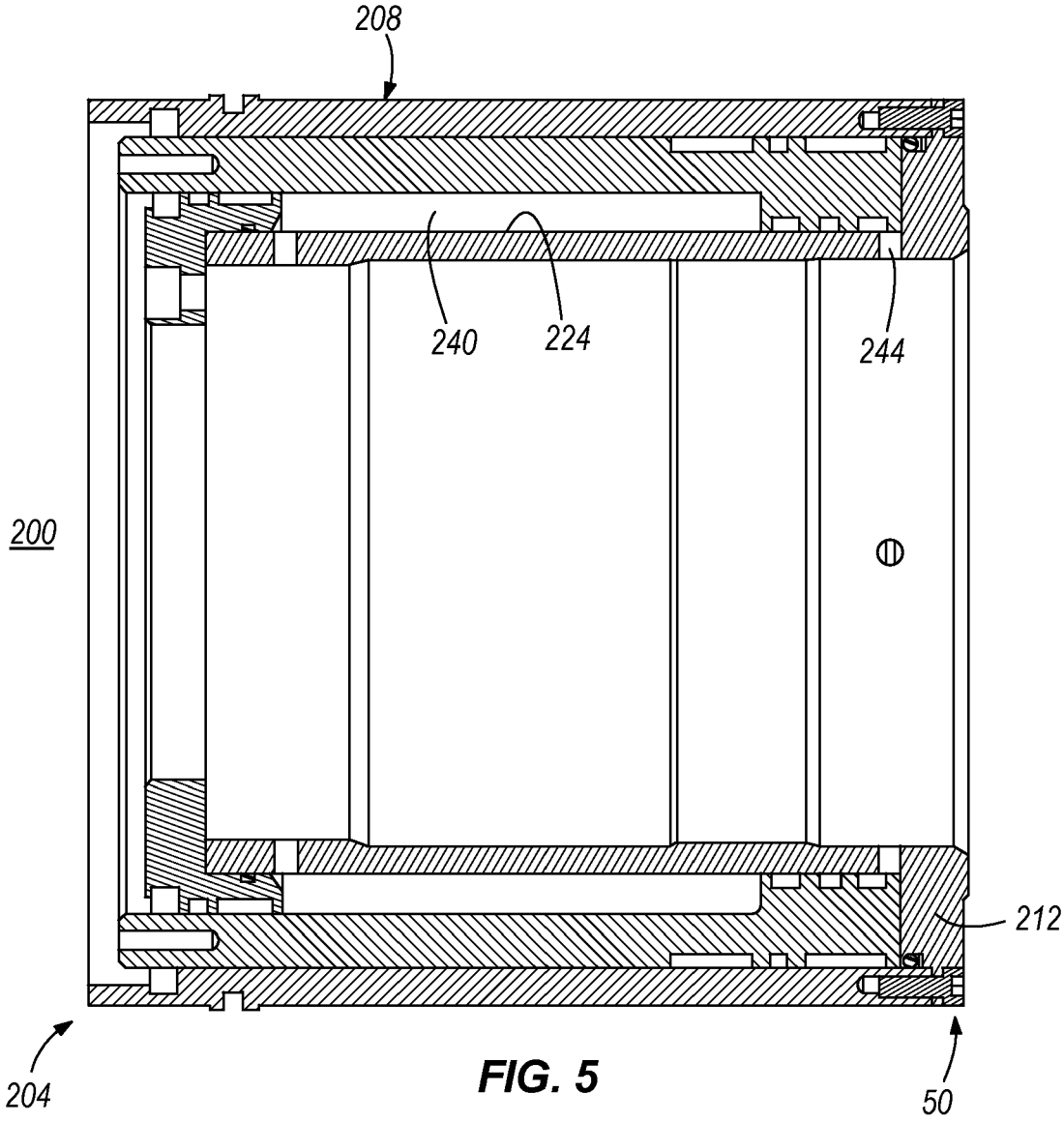
FIG. 5 is a section view of one end of a cutter head assembly according to this disclosure with the drum extension portion in its retracted position.
Figure 6:
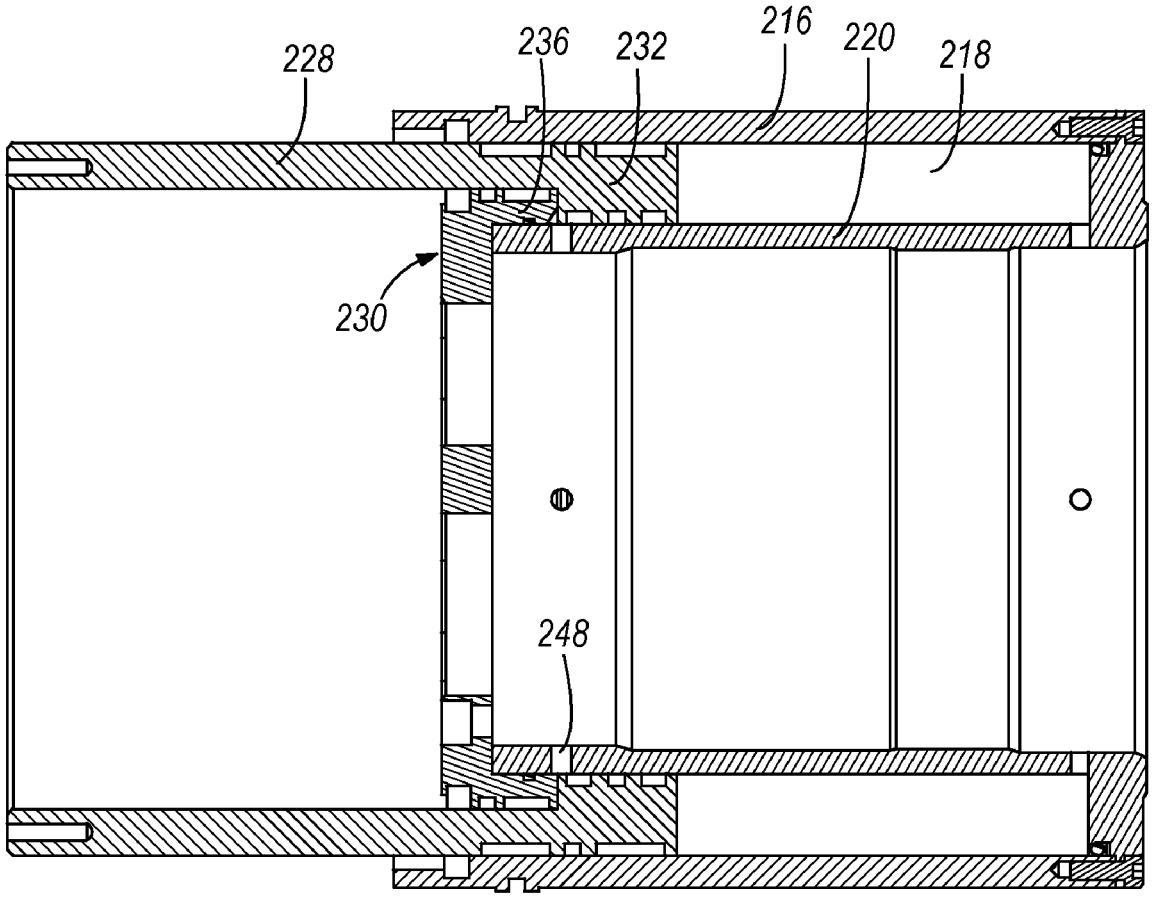
FIG. 6 is a section view of one end of a cutter head assembly according to this disclosure with the drum extension portion in its extended position.

Illustrated in FIGS. 5 and 6 is a mining machine cutting structure 200 according to this disclosure. Where like elements are found in FIGS. 1 and 2 of the drawings, reference will be made to FIGS. 1 and 2.

The mining machine cutting structure 200 includes a support member 18, and an elongated cutting head assembly 204 mounted at the forward end of the support member for powered rotation about a longitudinal axis. The cutting head assembly 204 comprises a centrally located main cutting head 50, and at least one drum extension portion 208 located at an end of the cutting head assembly 204 axially outward of the main cutting head 50. The drum extension portion 208 is capable of moving in an axial direction along the longitudinal axis from a retracted position to an extended position with respect to the main cutting head 50. More particularly, the drum extension portion 208 includes a toroidal hydraulic cylinder for selectively extending and retracting the drum extension portion 208.

Figure 3:
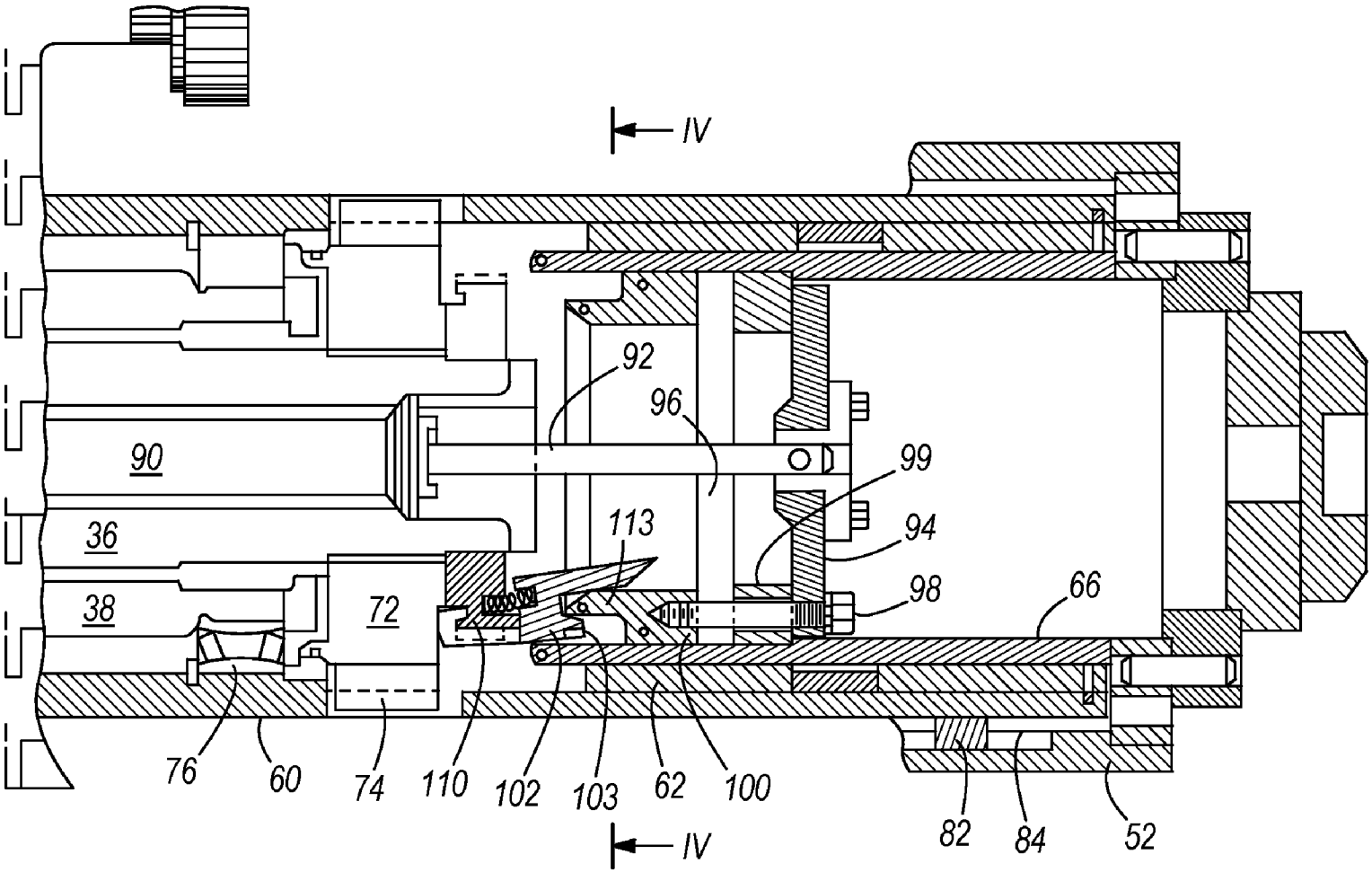
FIG. 3 PRIOR ART
FIG. 3 is an enlarged view showing the half of the cutter head assembly as is shown in FIG. 2 with the latch mechanism shown in the unlatched position with the extension retracted.
Figure 4:
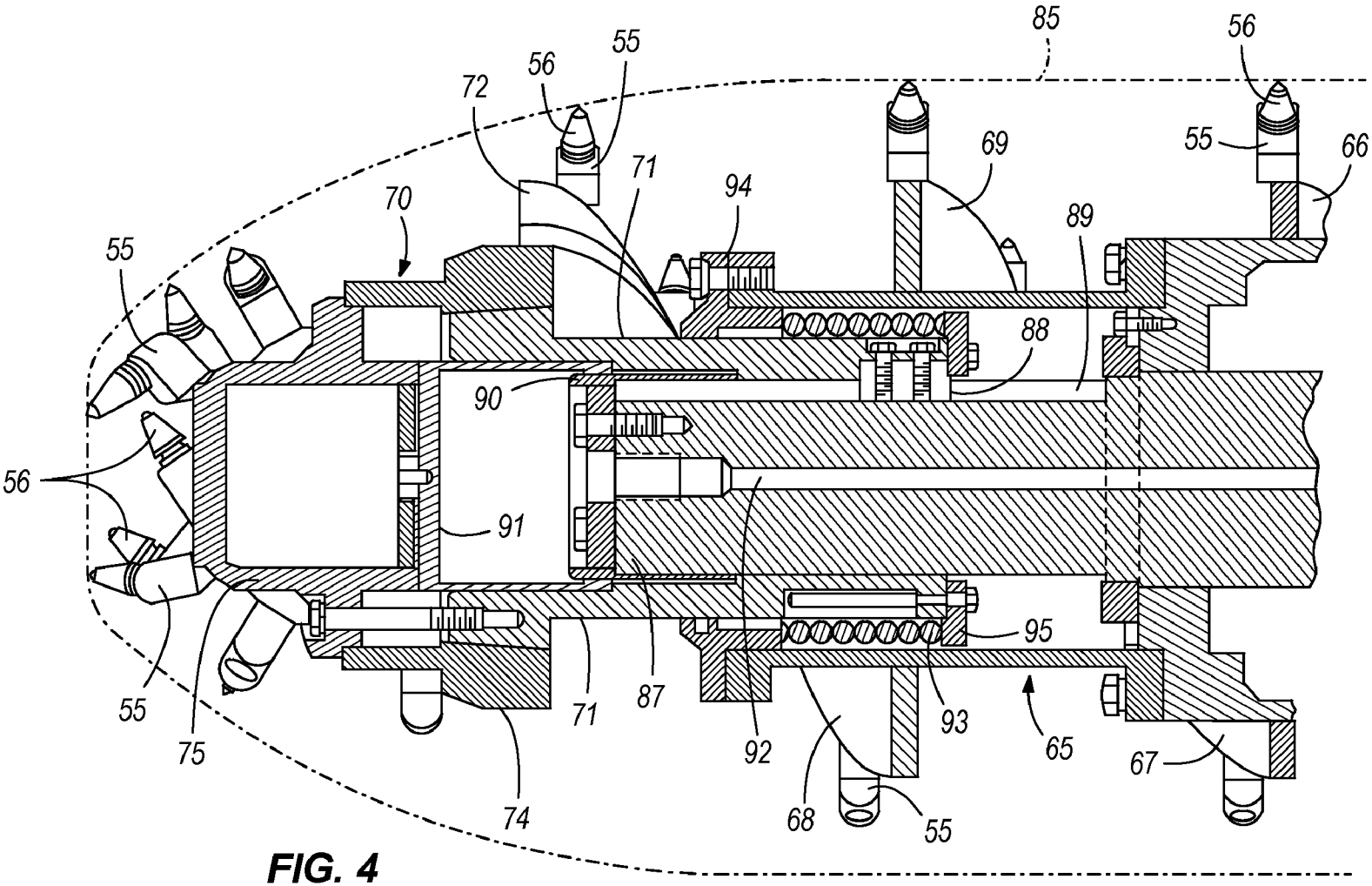
FIG. 4 PRIOR ART
FIG. 4 is a section view of one end of a prior art cutter head assembly.

The drum extension portion 208 has an axial inner end adjacent the main cutting head 50 and an axial outer end, and the drum extension portion 208 includes an inner end structure 212 attached to the main cutting head 50. The drum extension portion 208 also includes an outer cylinder 216 attached to the inner end structure 212, and an inner cylinder 220 attached to the inner end structure 212. The inner cylinder 220 also has an outer surface 224, and the inner cylinder 220 is coaxial with and received within but spaced apart from the outer cylinder 216. The inner cylinder 220 is also adapted to be connected (not shown), as is cylinder 66 in FIGS. 2 and 3, to an outer cutter head 60.

The drum extension portion 208 also includes an extendable cylinder 228 and an end cap 230. The extendable cylinder 228 has an inner annular enlarged end 232, and a portion of the extendable cylinder 228 is received between the inner cylinder 220 and the outer cylinder 216. The enlarged end 232 has seals and bearings to support sliding movement of the extendable cylinder 228 between the inner and outer cylinders. A first space 218 is defined between the inner end structure 212 and the enlarged end 232 of the extendable cylinder 228.

The end cap 230 has an axially extending flange 236 that receives coaxially within it the outer end of the inner cylinder 220, the extendable cylinder enlarged end 232 being received between the end cap flange 236 and the outer cylinder 216. The flange 236 has seals and bearings to support sliding movement of the extendable cylinder 228 between the flange 236 and the outer cylinder 216. A second space 240 is defined between the inner cylinder 220 and the extendable cylinder 228, and between the extendable cylinder enlarged end 232 and the end cap flange 236, so that when fluid enters the first space 218 and leaves the second space 240, the extendable cylinder 228 moves to the extended position, and so that when hydraulic fluid enters the second space 240 and leaves the first space 218, the extendable cylinder 228 moves to the retracted position.

The inner cylinder 220 has an extend port 244 through the inner cylinder 220 and communicating with the first space

218, and a retract port 248 through the inner cylinder 220 communicating with the second space 240. Conventional porting (not shown) through the elongated cutting head assembly 204 causes fluid under pressure to selectively enter the ports 244 or 248 to extend or retract the drum extension portion 208.

Various other features of this disclosure are set forth in the following claims.

The invention claimed is:

1. A mining machine cutting structure including a support member, an elongated cutting head assembly mounted at the forward end of said support member for powered rotation about a longitudinal axis, said cutting head assembly comprising:

a centrally located main cutting head portion, and at least one drum extension portion located at an end of said cutting head assembly axially outward of said main cutting head portion, said drum extension portion being capable of moving in an axial direction along said longitudinal axis from a retracted position to an extended position with respect to said main cutting head portion, said drum extension portion having an axial inner end adjacent the main cutting head portion and an axial outer end, and said drum extension portion including:

an inner end structure attached to said main cutting head portion, an outer cylinder attached to said inner end structure, an inner cylinder attached to said inner end structure and having an outer surface, said inner cylinder being coaxial with and received within but spaced apart from said outer cylinder, an extendable cylinder having an inner annular enlarged end, a portion of said extendable cylinder being received between said inner cylinder and said outer cylinder for a sliding movement of the extendable cylinder between the inner cylinder and the outer cylinder, a first space being defined between the inner end structure and the enlarged end of the extendable cylinder, and an end cap positioned at an outer end of the inner cylinder, the end cap having a flange that receives coaxially within it the outer end of the inner cylinder, the extendable cylinder enlarged end being received between the end cap flange and the outer cylinder, and a second space being defined between said inner cylinder and said extendable cylinder and between said extendable cylinder enlarged end and said end cap flange, so that when fluid enters said first space and leaves said second space, said extendable cylinder moves to said extended position, and so that when hydraulic fluid enters said second space and leaves said first space, said extendable cylinder moves to said retracted position.

2. A mining machine cutting structure in accordance with claim 1, said inner cylinder having an extend port through said inner cylinder and communicating with said first space.

3. A mining machine cutting structure in accordance with claim 1, said inner cylinder having a retract port through said inner cylinder communicating with said second space.

* * * * *